US005289249A

United States Patent [19]

Yamamoto et al.

[11] Patent Number: 5,289,249

[45] Date of Patent: Feb. 22, 1994

[54] ELECTROPHOTOGRAPHIC PRINTER HAVING A GRAVITY DRIVEN TONER RECYCLING UNIT

[75] Inventors: Mikio Yamamoto; Minoru Isobe; Yoshiharu Momiyama; Shigeki Nakajima; Hisao Ono, all of Tokyo, Japan

[73] Assignee: Oki Electric Industry Co., Ltd., Tokyo, Japan

[21] Appl. No.: 878,919

[22] Filed: May 6, 1992

[30] Foreign Application Priority Data

May 13, 1991 [JP] Japan ..... 3-107410

[51] Int. Cl.[5] ..... G03G 15/08; G03G 21/00

[52] U.S. Cl. ..... 355/298; 355/269

[58] Field of Search ..... 355/260, 269, 298

[56] References Cited

U.S. PATENT DOCUMENTS

| | | | |
|---|---|---|---|
| 4,030,824 | 6/1977 | Smith | 355/298 |
| 4,752,805 | 6/1988 | Fukae et al. | 355/298 |
| 4,931,838 | 6/1990 | Ban et al. | 355/260 |
| 5,045,879 | 9/1991 | Takaoka et al. | 355/269 X |
| 5,121,165 | 6/1992 | Yoshida et al. | 355/260 |
| 5,126,799 | 6/1992 | Matsuura et al. | 355/298 |

FOREIGN PATENT DOCUMENTS

| | | |
|---|---|---|
| 0282223 | 9/1988 | European Pat. Off. . |
| 4038677 | 6/1991 | Fed. Rep. of Germany . |
| 2226268 | 9/1990 | Japan . |

*Primary Examiner*—Fred L. Braun

*Attorney, Agent, or Firm*—Spencer, Frank & Schneider

[57] ABSTRACT

An electrophotographic printer which includes a developing device for developing an electrostatic latent image formed on the surface of a photoconductor by adhering a developer thereto, a cleaning device for collecting the developer which remains on the photoconductor for reuse after the transference of the developer, and a toner recycling route for flowing the collected developer from the cleaning device back to the developing device by gravity. The photoconductor is exposed to a light source prior to the developer being applied to the surface of the photoconductor.

5 Claims, 9 Drawing Sheets

ELECTROPHOTOGRAPHIC PRINTER HAVING A GRAVITY DRIVEN TONER RECYCLING UNIT

BACKGROUND OF THE INVENTION

1. Field of the Invention

The present invention relates to an electrophotographic printer composed of a photoconductor, a developing device, and a cleaning device and particularly to an electrophotographic printer which can reuse developer remaining on a photosensitive drum.

2. Technology Review

Electrophotographic printers employ a method of printing comprising the steps of exposing a charged photoconductor to an exposing light source to form an electrostatic latent image on the surface of the photoconductor, developing the latent image by applying toner powder thereto, and thereafter transferring the thus developed toner image onto a recording medium such as a recording paper.

FIG. 9 is a schematic side view of an exemplified arrangement of such an electrophotographic printer. In the figure, denoted at 1 is a photosensitive drum having on the surface thereof a photosensitive semiconductor such as a Se photoconductor, a Cds photoconductor, an amorphous Silicon photoconductor, an organic photoconductor or (OPC); 2 is a first electrifier; and 3 is light for forming an image coming from a light source, not shown. Denoted at 4 is a developing device comprising a toner tank 4*a* disposed therein for storing toner, 5 is a sheet guide, 6 is a transferring electrifier, 7 is a fixing device, and 8 is a light source for removing electrical charge. Denoted at 9 is a cleaning device, 10 is a developing roller disposed in the developing device 4, 11 is a recording paper, and 12 is a feed roller for feeding the recording paper 11.

In the thus constructed electrophotographic printer, the photosensitive drum 1 is rotated at a given speed in the direction of the arrow R so that the surface of the photosensitive drum 1 is uniformly electrified by the first electrifier 2. A latent image is formed on the surface of the electrified photosensitive drum 1 by radiating light 3 from an exposing light source. The thus formed latent image reaches a position opposing the developing roller 10 in the developing device 4 as the photosensitive drum 1 is rotated in the direction of the arrow R. The toner supplied from a toner reservoir by way of the developing roller 10 adheres to the photosensitive drum 1 to make the visible latent image.

Recording paper 11 which is fed sheet by sheet from a paper feed portion by way of the feed roller 12 are transported to the upper portion of the transferring electrifier 6 along a sheet guide 5 in accordance with the rotation of the photosensitive drum 1. The toner image formed on the photosensitive drum 1 is transferred onto the recording paper 11 by the transferring electrifier 6. The recording paper 11 on which the toner image is transferred but not fixed is transported toward a fixing device 7 by a transporting means, not shown, and the toner image is fixed on the recording paper 11 by being heated or pressed in the fixing device 7 to complete printing.

The latent toner image on the photosensitive drum 1 is thereafter erased by irradiation from the light source 8. The toner which remains on the photosensitive drum 1, instead of being transferred onto the recording paper, is removed and collected by the cleaning device 9. The photosensitive drum 1 is electrified again by the first electrifier 2 for successive image forming processing after complete removal of the toner by the cleaning device 9.

The toner collected in a collecting case 9*a* provided in the cleaning device 9 is regularly removed by an operator or a person in charge of maintenance of the electrophotographic printer.

However, when the electrophotographic printer is used frequently or for a long time, the increased quantity of collected toner causes a frequent, troublesome dumping operation. As a result, a large collecting case has to be used in order to reduce the frequency of the dumping operation, thus resulting in a large sized electrophotographic printer.

Consequently, an electrophotographic printer in which the toner collected by the cleaning device 9 is recycled to the developing device 4 has been provided recently.

FIG. 10 is a schematic side view showing an arrangement of such an exemplified electrophotographic printer in which the toner is recycled to the developing device. As illustrated in the figure, the remaining toner 19 which has not been transferred onto the recording paper is transported to the cleaning device 20 while the electric charge on the photosensitive drum 1 is discharged by a light source 8, with the rotation of the photosensitive drum 1 in the direction of the arrow R. For collecting the toner 19, there are various methods such as using a blade or a brush. An embodiment using a brush will now be described.

A cleaning brush denoted at 21 scrapes off the remaining toner 19 from the photosensitive drum 1 as it rotates in the direction of the arrow A, to transfer the toner 19 onto a collecting roller 22. At this time, a blade 23 scrapes off the toner 19 causing it to fall into a guide 24 after the toner 19 is transferred from the cleaning brush 21 to the collecting roller 22 by an electrostatic effect (force).

An Auger shaft, feed spring, etc. (not shown), provided on the lower portion of the guide 24 transport the dropped toner 19 toward a sending portion 25*a*. The toner 19 is transported from the sending portion 25*a* into a guide pipe 25. Another Auger shaft (not shown) is provided to transport the toner 19 by the rotation thereof to a conveying in portion 25*b* provided on the developing device 4. The toner 19 is recycled into the developing device 4 from the conveying in portion 25*b*. As described above, the toner 19 collected by the cleaning device 20 is recycled to the developing device 4 by way of the guide pipe 25 for reuse in developing. The recycling of the toner 19 makes it unnecessary to carry out the troublesome dumping operation and can reduce the amount of toner consumed in the electrophotographic printer.

There are, however, the following three problems in the conventional electrophotographic printer described above in which the remaining toner is recycled to the developing device 4 for reuse.

The first problem is that the electrophotographic printer has a wide width and needs a large floor area for its installation since the guide pipe 25 for transporting the collected toner from the cleaning device 20 to the developing device 4 is provided aside the photosensitive drum 1.

The second problem is that the toner collected is unevenly distributed (piled locally) in the side edge portion of the developing device 4 since the toner flows back into the developing device 4 from the conveying in portion 25*b* in the side edge portion of the developing device 4.

The third problem is that the collected toner clogs the guide pipe 25.

These problems will be described more in detail hereinafter with reference to FIG. 11 which is a schematic plan view showing the arrangement of the electrophotographic printer illustrated in FIG. 10 in which the toner is recycled to the developing device 4 for reuse.

The first problem comes from the fact that the guide pipe 25 is provided aside the photosensitive drum 1, as easily understood from FIG. 11. Generally the width of the recording portion of an electrophotographic printer is determined by the width of the photoconductor, i.e., the photosensitive drum 1. This is because the developing roller 10 housed in the developing device 4 and the cleaning brush 21 provided in the cleaning device 20 are shorter than the photosensitive drum 1 in width. As a result, if the collected toner recycling route is designed so as to pass aside the photoconductor, the electrophotographic printer becomes wider by the width of the guide pipe 25, as understood from FIG. 11.

The second problem comes from the fact that the collected toner is carried back to the side edge portion of the developing device 4 from the conveying in portion 25*b* of the guide pipe 25, as understood from FIG. 11.

Toner is stored uniformly in the width direction of the developing device 4 when it is supplied thereto, and it is fed to an electrostatic latent image on the photoconductor by way of the developing roller 10.

However, the collected toner which has been carried back by way of the guide pipe 25, is carried back to the side edge portion of the toner containing portion of the developing device 4, so that the toner is piled in the vicinity of the side edge portion as described above, and is not distributed evenly in the toner containing portion. When the toner is not distributed evenly in the developing device, it is difficult to correctly detect the presence or absence of toner in the developing device. That is, the presence of remaining toner is reported when the sensor detects the presence of toner in the vicinity thereof, and the absence of toner is reported when the sensor does not detect the toner in the vicinity thereof. But if the toner is not evenly distributed (if much toner remains in the side edge portion as described above) in the developing device, it sometimes occurs that there remains very little toner on the opposite side of the sensor (the opposite side of the side edge portion 25*b* in the developing device 4 to which the toner is carried back) even if the sensor detects toner in the vicinity thereof, which results in the deterioration of printing quality (partial reduction in printing density).

Furthermore, inasmuch as the collected toner is electrically charged at a reverse electrical potential, its major portion is different in electric potential from that first supplied to the developing device. As a result, printing quality is liable to be partially deteriorated, which is caused by the difference in electric charge between the collected toner and the first stored toner when they are unevenly distributed in the developing device.

Also, when the toner is removed from the photoconductor by the cleaning device, powders of paper which has adhered to the photoconductor are also swept together with the toner, and are carried back to the developing device 4 by way of the guide pipe 25 with the toner. Other than the powders of paper, an antistatic agent which was primarily added to the toner and came off in the course of printing is also collected by the cleaning device and carried back to the developing device. As a result, they cause blurred printing or uneven density in printing when they are unevenly distributed in the developing device 4 although it does not matter when they constitute a very small amount and are evenly distributed therein.

The third problem is caused by the friction between the toner and the inner surface of the guide pipe 25, the electric charge due to the friction between the toner and the Auger shaft for feeding and the deformation and deterioration of the toner due to the friction between the toner and the guide pipe 25 or Auger shaft. The electrostatic charge due to friction causes condensation of the toner itself, which deteriorates its fluidity, or the adhesion of the toner to the inner surface of the guide pipe 25 by electrostatic force, which deteriorates its fluidity locally. The deformation of toner particles also deteriorates its fluidity so that toner fed one after another are caught in the portion where the fluidity of the toner is deteriorated and finally clogs the guide pipe 25. When the guide pipe 25 is clogged by toner, the flow of toner is stopped entailing the inundation of toner in the cleaning device and dirty printing caused by insufficient cleaning.

SUMMARY OF THE INVENTION

It is the first object of the present invention to provide a small sized toner recycling type electrophotographic printer.

It is the second object of the present invention to provide an electrophotographic printer which can collect uniformly toner powder into a built-in developing device.

It is the third object of the present invention to provide an electrophotographic printer which can prevent a recycling route from being clogged by collected toner powder.

In an electrophotographic printer according to the present invention wherein an electrostatic latent image formed on the surface of a photoconductor is developed by adhering a developer to said electrostatic latent image by means of a developing device, a transferring device transfers the developed latent image on a recording medium, and a cleaning device collects the developer which remains on the surface of the photoconductor, the electrophotographic printer is characterized in that the collected developer recycling route allows collected developer to recycle from the cleaning device back to the developing device by gravity.

With the arrangement set forth above, it is possible to provide a toner recycling type electrophotographic printer having a small width which can collect toner powder uniformly into a built-in developing device, and which can prevent the toner recycling route from being clogged by toner powder.

DESCRIPTION OF THE PREFERRED EMBODIMENT

An electrophotographic printer according to the first to seventh embodiments will be described with reference to FIGS. 1 to 8 in which common elements are denoted by the same numerals.

Figure 1:
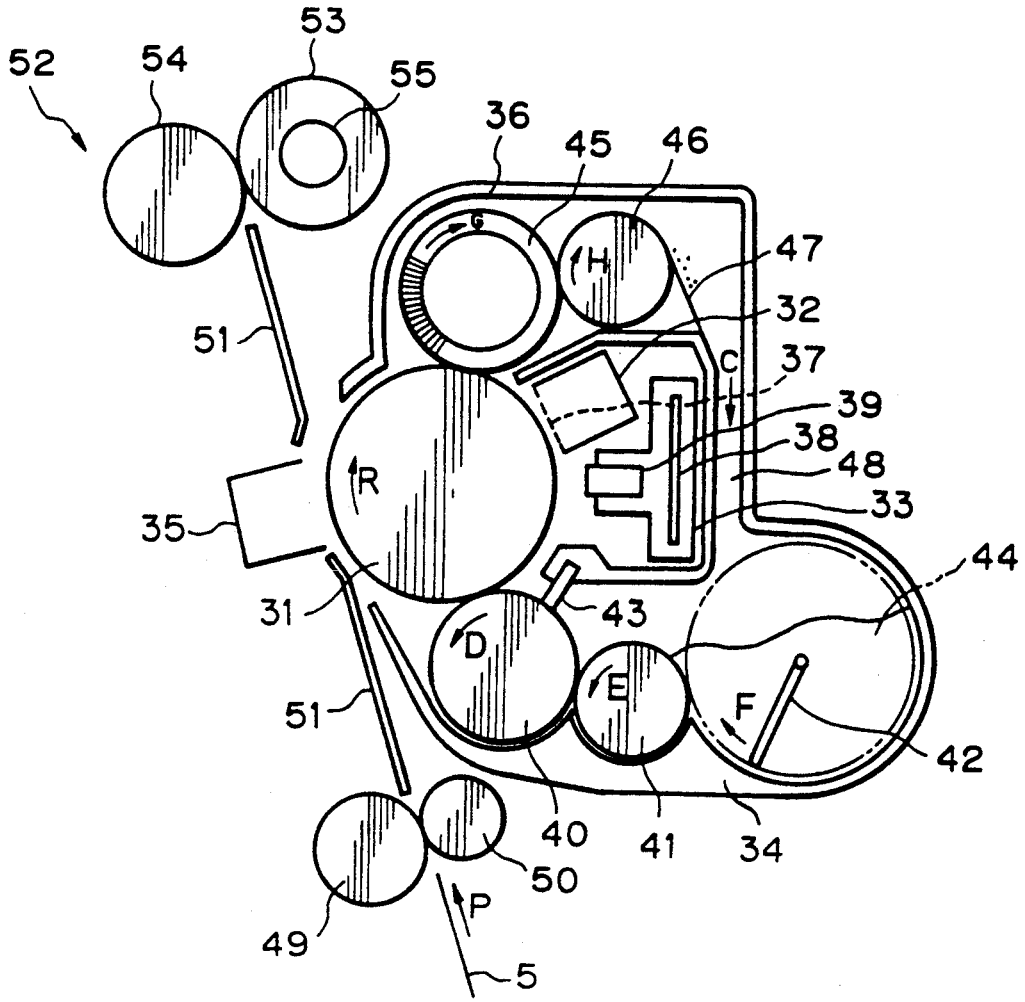
FIG. 1 is a schematic side elevational view showing the main portion of an electrophotographic printer according to the present invention.
Figure 2:
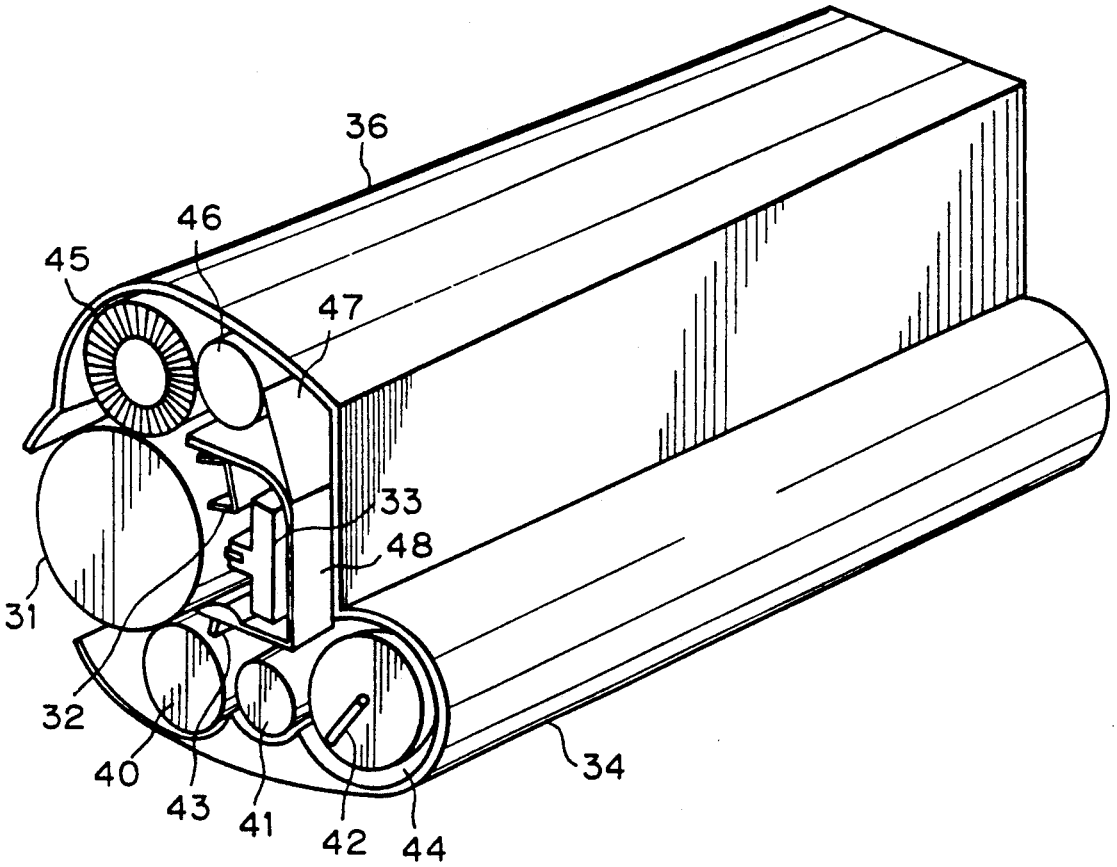
FIG. 2 is a perspective view of the main portion of an electrophotographic printer according to the first embodiment of the present invention.

First Embodiment (FIGS. 1 and 2)

The electrophotographic printer according to the first embodiment will be described with reference to FIGS. 1 and 2 in which FIG. 1 is a schematic side view showing a main portion of the electrophotographic printer according to the first embodiment of the present invention and FIG. 2 is a schematic perspective view of the electrophotographic printer shown in FIG. 1.

In FIGS. 1 and 2, a first electrifier 32, an exposing light source 33, a developing device 34, a transferring electrifier 35 and a cleaning device 36 are disposed around a photoconductor 31. A grid 37 is fixed to the first electrifier 32 for stabilizing the potential on the surface of the photoconductor 31. The exposing light source 33 comprises an LED (light emitting diode) array 38 and a rod lens array 39. The photoconductor 31, the first electrifier 32 and the exposing light source 33 are attached to the body of the electrophotographic printer by attaching means, not shown.

The developing device 34 comprises a developing roller 40, a transporting roller 41, a stirring roller 42 and a blade 43. A toner reservoir 44 to which the stirring roller 42 is fixed stores a developer such as toner (or toner powder) therein. The developing roller 40 contacts the photoconductor 31 while the transporting roller 41 contacts the developing roller 40. The blade 43 is brought into contact with the developing roller 40 under pressure. A fixed bias voltage is applied to the developing roller 40 and the transporting roller 41 from a power source, not shown.

The cleaning device 36 has therein a brushing roller 45, a collecting roller 46 and a scraper 47. The brushing roller 45 has knitted conductive fibers on the circumference thereof and contacts the photoconductor 31. A positive voltage is applied to the brushing roller 45 from the power source, not shown. The collecting roller 46 rotates while contacting the brushing roller 45. Applied to the collecting roller 46 is a positive voltage which is higher than the positive voltage applied to the brushing roller 45. The scraper 47 contacts the collecting roller 46 at one end thereof for scraping off the toner on the surface of the collecting roller 46. A toner recycling route or passageway 48 is formed between the cleaning device 36 and the developing device 34. The electrophotographic printer is installed in the direction shown in FIG. 1. The recycling route 48 has a length extending perpendicularly, i.e. vertical relative to the surface of the floor on which the electrophotographic printer is installed and operates to feed the toner scraped off by the cleaning device 36 to the developing device 34 by gravity. The recycling route 48 is not longer than the axial length of the photoconductor 31. The lower end of the scraper 47 extends to the upper portion of the recycling route 48.

In FIG. 1, a resist roller 49, a pressure roller 50, a transporting guide 51 and a fixer 52 are provided in the transporting route of the recording papers for transporting and fixing the same. The fixer 52 is composed of a fixing roller 53 and a backup roller 54, and a heater 55 is incorporated in the fixing roller 53.

The operation of the thus constructed electrophotographic printer will be described hereinafter with reference to FIG. 1.

The photoconductor 31 is rotating at a given speed in the direction of the arrow R, and is uniformly charged with electricity by the first electrifier 32. The LED array 38 provided in the exposing light source 33 emits light corresponding to the recording signal in response to the image data supplied by a control circuit, not shown, so as to focus into an image and form an electrostatic latent image on the photoconductor 31 by way of the rod lens array 39. The thus formed electrostatic latent image is developed by the developing device 34. The developing device 34 composed of the developing roller 40, the transporting roller 41 and the stirring roller 42, permits the toner in the toner reservoir 44 to adhere to the surface of the developing roller 40 by way of the blade 43 to form a thin layer thereon and then selectively transfer the toner onto the photoconductor 31 for developing.

The toner in the toner reservoir 44 is stirred by rotation of the stirring roller 42 in the direction of the arrow F, and is transported to the developing roller 40 by rotation of the transporting roller 41 in the direction of the arrow E. The transported toner adheres to the surface of the developing roller 40 to form a thin layer thereon by way of the blade 43. At this time, a given biasing voltage is applied to the developing roller 40 and the transporting roller 41 by a power source, not shown, so as to attract, transport and develop the negatively charged toner by electrostatic force. The toner is charged with electricity by friction with the blade 43 and the amount of electricity is finally determined. A developing potential is determined by a bias potential which is applied to the developing roller 40 and developing is carried out between the electrostatic latent image on the photoconductor 31 and the toner and a toner image is formed on the photoconductor 31.

The recording paper 5 is separatedly transported in the direction of the arrow P from a paper feed portion, not shown, before the toner image formed on the photoconductor 31 turns to the position facing the transferring electrifier 35. The recording paper 5 is controlled so as to be temporarily stopped by the resist roller 49 and the pressure roller 50, then transported simultaneously with the start of irradiation of the exposing light source 33 so that the toner image formed on the photoconductor 31 may be transferred onto the recording paper 5 at a predetermined position thereof.

When the recording paper 5 reaches the transferring electrifier 35 by way of resist roller 49, a positive voltage is applied to the transferring electrifier 35 so as to transfer the toner image formed on the photoconductor 31 onto the recording paper by electrostatic force. Inasmuch as the photoconductor 31 has a small radius of curvature, the recording paper 5 to which the toner image has been transferred is separated from the photoconductor 31 by its rigidity, and is transported toward a fixing roller 53. As to the mechanisms for separating the recording paper 5 from the photoconductor 31, a method of removing electricity from the recording paper by applying alternating voltage, separating with the use of separating pawls and the like has been well known. In contrast, the present invention employs a separating mechanism making use of the curvature of the photoconductor 31 and the rigidity of the recording paper 5. A halogen lamp 55 is provided as a heat source inside the fixing roller 53 in order to fix the toner image to the recording paper 5 by heating and pressing the same cooperating with a backup roller 54. On the photoconductor 31, there remains toner which has not been transferred to the recording paper 5 after the toner image is transferred thereto by the transferring electrifier 35, and the toner has to be eliminated.

The brushing roller 45 rotates in the direction of the arrow G to remove the toner remaining on the photoconductor 31. Although various types of brushes for the brushing roller 45 are proposed, a brush knit out of conductive fibers will be described hereinafter. A positive voltage is applied to the brushing roller 45 by a power source, not shown, so that the toner remaining on the photoconductor 31 is not only scraped off by the brush but also attracted by the electrostatic force, whereby the photoconductor 31 is cleansed.

The method of removing electricity by irradiating the whole surface of the photoconductor with light before cleaning the same has been described in the prior art explanation in the present application. If necessary the method may be employed in the electrophotographic printer of this embodiment.

As described above, the toner remaining on the photoconductor 31 is charged with negative electricity in the developing device 34, so that it can be effectively removed from the photoconductor 31 by charging the brushing roller 45 with positive electricity. The removed toner is transferred to the collecting roller 46 by applying a positive voltage higher than that of the brushing roller 45 so as to clean the brushing roller 45. In this way, the toner remaining on the photoconductor 31 is transferred successively to the brushing roller 45 and then to the collecting roller 46.

The toner transferred to the collecting roller 46 is scraped off by a scraper 47 to slip down along the surface of the scraper 47 in the direction of the arrow C, falls by gravity through a passage 48 which is formed vertically with respect to the surface on which the electrophotographic printer is installed, and returns into the developing device.

This toner recycling route 48 is formed vertically with respect to the surface on which the electrophotographic printer is installed by being provided on the opposite side of the photoconductor 31 relative to the exposing light source 33, which enables the toner collected by the cleaning device to flow back to the developing device 34 without enlarging the area on which the electrophotographic printer is installed.

It is possible to form a vertical toner recycling route 48 in the vicinity of the scraper 47 by employing a compact array type light source as the exposing light source 33. Since the toner recycling route 48 enables the collected toner to recycle to the developing device 34, the area for installation of the toner recycling type electrophotographic printer can be minimized.

The toner which is carried back comprises a small portion of toner having different electric potentials, paper powders of the recording papers, antistatic agents separated from the toner, etc., which are also detrimental to developing in the electrophotographic printer of the present invention. However, since the toner recycling route has a width (length in the direction parallel to the longitudinal direction of the photoconductor) substantially as wide as the entire width of the printing area on the photoconductor 31, the toner which is carried back is uniformly distributed in the toner reservoir 44 of the developing device 34 in the width direction thereof so as to be stirred with the toner remaining in the toner reservoir 44 with the stirring roller 42. As a result, it is possible to prevent the deterioration of printing quality caused by the uneven distribution of the collected toner inside the developing device 34.

As described above, since the electrophotographic printer according to the present invention comprises a wide toner recycling route in which the toner flows back into the developing device 34 by gravity, the toner can be prevented from being damaged or clogging the guide pipe due to the friction between the transporting member of the Auger shaft and the toner, which were liable to occur in the conventional electrophotographic printers.

Although the LED array composed of arrayed LEDs (Light Emitting Diode) was exemplified as the exposing light source in this embodiment, it should not be limited to an LED array so far as it is an exposing light source array. For example, it is possible to employ a liquid crystal shutter array which is a combination of a liquid crystal shutter and a light source, an EL array comprising an EL (Electro-Luminescence) as a light source, a PD array comprising a PD (Plasma Display) array as a light source, a magnetic optical shutter array which is a combination of a magnetic optical shutter and a light source, a FDT array comprising a fluorescent character display tube which is composed of phosphor layered on an anode, a grid electrode and a cathode filament and the like.

Although the brushing roller 45 was employed by the cleaning device 36 in the above description, a sponge roller can be employed instead of the brushing roller 45 by the cleaning device 36. In this case the toner remaining on the photoconductor 31 is removed by the sponge roller mechanically and electrostatically, and the toner which adheres to the sponge roller is removed by the collecting roller 46, so that the remaining toner can be removed in the same way as in the cleaning device employing the brushing roller 45.

An organic photoconductor (OPC) is employed for a photoconductor in this embodiment, but other photoconductors can be employed without being limited to the organic photoconductor.

Figure 3:
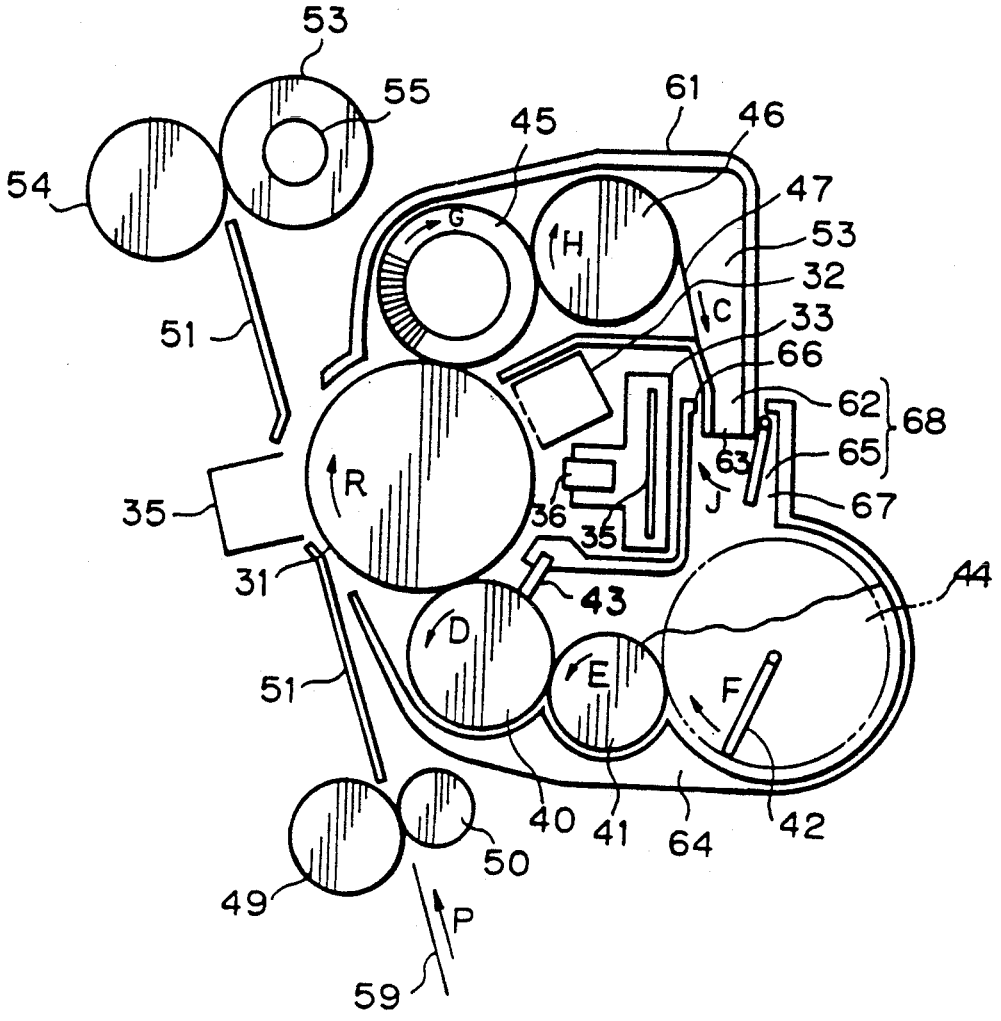
FIG. 3 is a schematic side view showing the main portion of an electrophotographic printer according to the second embodiment of the present invention.

Second Embodiment (FIG. 3)

The first embodiment which is a basic embodiment of the present invention has been described above, and a second embodiment which is a partially modified first embodiment will be described hereinafter with reference to FIG. 3.

FIG. 3 is a schematic side view of a main portion of the electrophotographic printer according to a second embodiment of the present invention.

In FIG. 3, a cleaning device 61 comprises a toner discharge portion 62 projecting downward, at the lower portion of which is formed an opening 63. At the upper portion of a developing device 64 is formed a toner receiving portion 65. The lower portion of the toner discharge portion 62 protrudes into an opening 66 formed at the upper portion of the toner receiving portion 65. A shutter 67 is provided at the toner receiving portion 65 so as to close the opening 66 when the developing device 64 is detached from the body of the electrophotographic printer. The toner discharge portion 62 and the toner receiving portion 65 to form a toner recycling route 68 for the toner to flow back which is collected in the cleaning device 61 to the developing device 64. Other components are the same as those described in the first embodiment, so that the description thereof is omitted.

The operation of the second embodiment will be described hereinafter.

Printing on the recording paper 5 by electrostatic process is the same as that described in the first embodiment, so that the description thereof is omitted. The cleaning of the remaining toner and the succeeding steps will be described hereinafter.

The toner remaining on the photoconductor 31 which has not been transferred onto the recording paper 5 is removed in the cleaning device 61. The remaining toner is removed from the photoconductor 31 by the brushing roller 45 and is then transported to the collecting roller 46 in the same way as in the first embodiment. The toner transferred to the collecting roller 46 is scraped off by a scraper 47, slips down along the surface of the scraper 47 and falls in the direction of the arrow C from the toner discharge portion 62 to the toner receiving portion 65 of the developing device 64, that is, through a toner recycling route 68. The toner recycling route 68 is formed vertically with respect to the surface on which the electrophotographic printer is installed by being provided on the opposite side of the photoconductor 31 relative to the exposing light source 33, which enables the toner collected by the cleaning device 61 to flow back to the developing device 64 without enlarging the area on which the electrophotographic printer is installed.

The toner receiving portion 65 of the developing device 64 is equipped with a shutter 67, which is pressed down by the toner discharge portion 62 of the cleaning device 61 when the electrophotographic printer is in use so that the collected toner may be able to flow back into the developing device 64. When the electrophotographic printer runs out of the toner in the developing device 64, the developing device 64 has to be replaced with a new one. When the developing device 64 is detached, the shutter 67 turns in the direction of the arrow J by the function of a spring or the like, not shown, so as to shut the opening 66 at the upper portion of the developing device 64.

Owing to such a closable construction of the opening 66 of the developing device 64, it is possible to prevent the toner in the developing device 64 from scattering to the outside of the device when a new developing device 64 having a toner reservoir 44 filled with toner is carried to the printer for replacing the old developing device. This renders the exchange of the developing device and the cleaning device independent of each other.

Consequently, according to the second embodiment, it is possible to provide an electrophotographic printer which is superior in running cost since the developing device and the cleaning device can be independently exchanged therein in addition to the effect of the first embodiment described above. It is because each unit of the electrophotographic printer such as a cleaning device, a developing device, a photoconductor, etc., has a shorter life compared with that of the body of the electrophotographic printer that they are considered to be expendable supplies. Moreover they are different from each other in that they have different lives so that the units of the electrophotographic printer can be effectively used by exchanging them individually according to their lives so as to reduce the running cost to a minimum.

Figure 4:
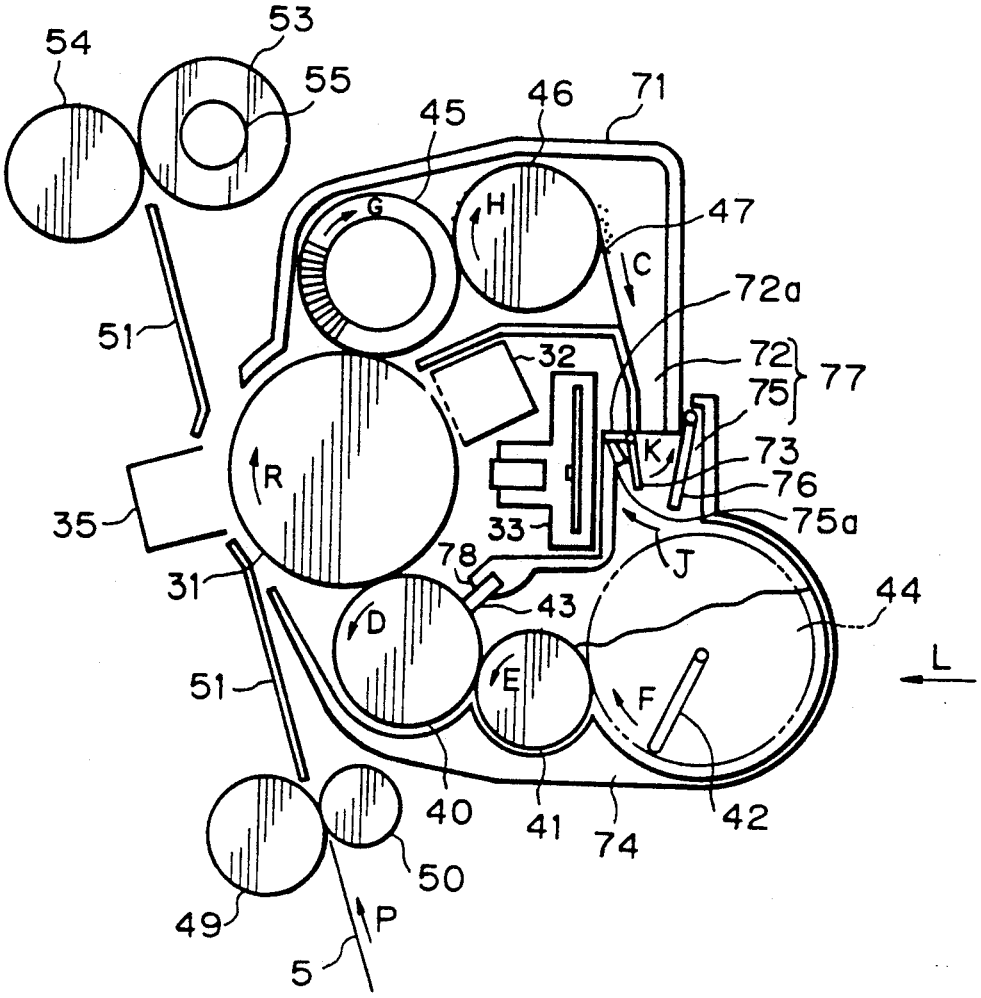
FIG. 4 is a schematic side view showing the main portion of an electrophotographic printer according to the third embodiment of the present invention.

Third Embodiment (FIG. 4)

The third embodiment which is a partial modification of the second embodiment will be described hereinafter with reference to FIG. 4. FIG. 4 is a schematic side view of the main portion of the third embodiment of the present invention.

In FIG. 4, the cleaning device 71 comprises a toner discharge portion 72 in the same way as the second embodiment, and further comprises a shutter 73 at the lower end portion of the toner discharge portion 72. A developing device 74 comprising a toner receiving portion 75, is combined with the toner discharge portion 72 when the electrophotographic printer is in use so as to be able to receive the collected toner. The upper end **75*a* of the toner receiving portion 75 on the side of the exposing light source 33 is disposed a little lower than that on the opposite side of the exposing light source 33 so that the lower end 72*a* of the toner discharge portion 72 on the side of the exposing light source 33 is stopped by the upper end 75*a* of the toner receiving portion 75 on the side of the exposing light source 33. This prevents the lower end 72*a* of the toner discharge portion 72 from entering the toner receiving portion 75. The toner receiving portion 75 is equipped with a shutter 76 at the upper portion thereof, and the toner discharge portion 72 and the toner receiving portion 75 form a recycling portion 77 of the collected toner. The blade supporting portion 78 of the developing device 74 is directed downward having no projection on the side of the exposing light source 33**. Other components are the same as those in the first and second embodiments, so the explanation thereof is omitted.

The operation of the third embodiment of the present invention will be described hereinafter.

The toner remaining on the photoconductor 31 after the transference of the toner image is scraped off by a brushing roller 45 of the cleaning device 71 and slips down along the scraper 47 by way of the collecting roller 46 in the direction of the arrow C to fall by gravity through the recycling portion 77 to the developing device 74. The shutter 76 provided on the developing device 74 and also the shutter 73 in a state illustrated in FIG. 4 are opened as they are in contact with and turned by the upper end 75*a* of the toner receiving portion 75 of the developing device 74, which keeps the shutters 76 and 73 open so that the collected toner can recycle from the cleaning device 71 into the developing device 74.

When the developing device 74 runs out of toner, it has to be replaced with a new one. When the developing device 74 is detached from the body of the electrophotographic printer, the shutter 76 is turned in the direction of the arrow J by the force of a spring, not shown, etc., to shut the opening portion at the upper portion of the developing device 74. In the same way, when the developing device 74 is detached from the body of the electrophotographic printer, the shutter 73 which is provided at the toner discharge portion 72 of the cleaning device 71 is turned in the direction of the arrow K by the resilient force of a spring, not shown, to shut the toner discharge portion 72 thereby preventing the toner from dropping out of the toner discharge portion.

As described above, the closable mechanism of the opening portion of the developing device 74 can prevent the toner in a replaced developing device from scattering outside the developing device. Inasmuch as the supporting portion 78 of the blade 43 in the developing device 74 is disposed at a position lower than the exposing light source 33 as illustrated in FIG. 4, the developing device 74 can be detached from or attached to the body of the electrophotographic printer in the direction of the arrow L so as to facilitate the exchange of the developing device 74. The cleaning device can be also exchanged independently with ease.

As described above, the third embodiment has additional advantages. That is, the shutter 73 can prevent the toner from dropping through the toner discharge opening of the cleaning device and staining the electrophotographic printer when the developing device is exchanged. Since the blade supporting portion 78 of the developing device 74 is disposed lower than the exposing light source, the developing device 74 can be detached from or attached to the body of the electrophotographic printer with ease, and the shutter 76 prevents the toner from dropping out of the discharge portion 72 so as to facilitate the exchange of the developing device.

Figure 5:
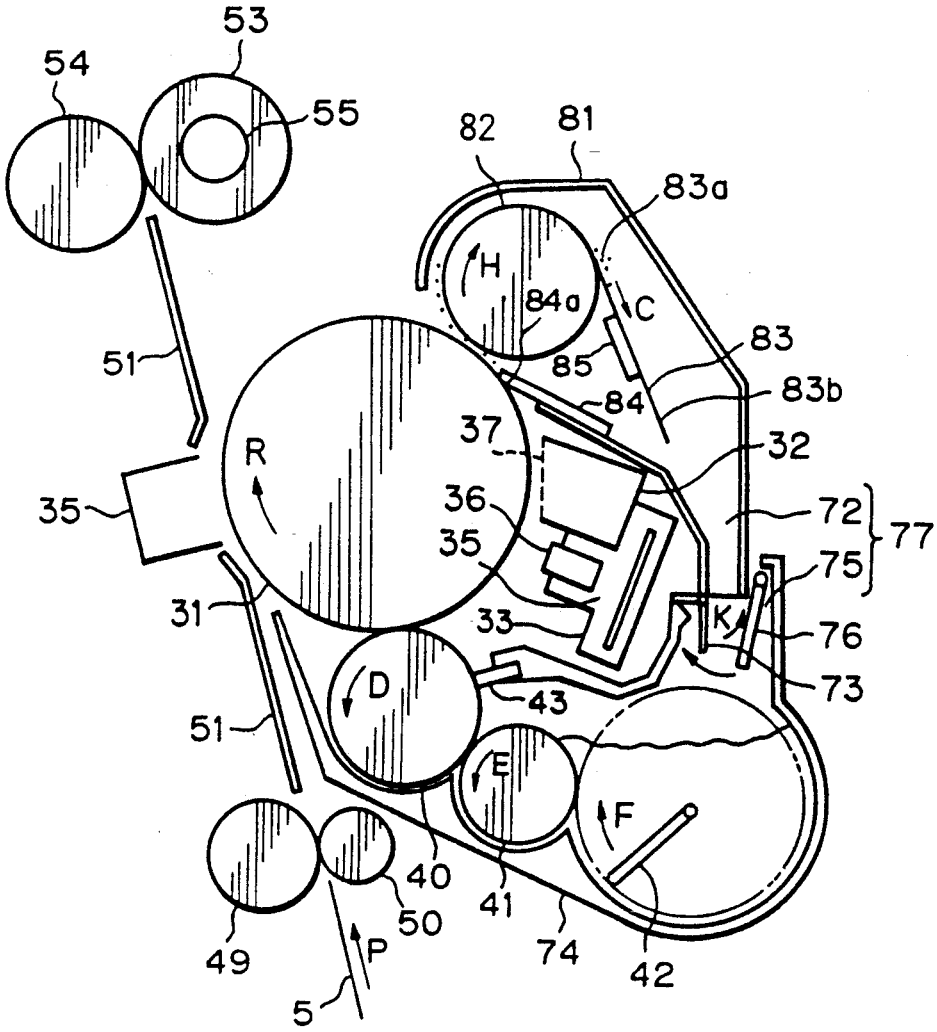
FIG. 5 is a schematic side view showing the main portion of an electrophotographic printer according to the fourth embodiment of the present invention.

Fourth Embodiment (FIG. 5)

The fourth embodiment of the present invention will be described with reference to FIG. 5.

FIG. 5 is a schematic side view of a main portion of the electrophotographic printer according to the fourth embodiment of the present invention. The cleaning device is different in construction in comparison with that of the third embodiment. In FIG. 5, a cleaning device 81 is composed of a collecting roller 82, a scraper 83 and a blade 84. The blade 84 made of an elastic body such as rubber etc. is uniformly in contact with the photoconductor 31 at the edge portion 84*a* thereof to scrape off the toner remaining on the photoconductor 31. The collecting roller 82 is rotatably arranged in the vicinity of the edge portion 84*a* of the blade 84 and a positive voltage is applied to the collecting roller 82 by a power source, not shown. One end 83*a* of the scraper 83 is uniformly in contact with the surface of the collecting roller 82, while the other end 83*b* thereof extends toward the toner discharge portion 72.

The construction of the toner discharge portion 72 is the same as that of the third embodiment. The toner discharge portion 72 and the toner receiving portion 75 of the developing device 74 form a recycling portion 77 for the collected toner. Other portions are the same in construction as those in the third embodiment.

The toner remaining on the photoconductor 31 is scraped off from the surface of the photoconductor 31 by the blade 84 and accumulates in the vicinity of the edge portion 84*a*. The toner charged with negative electricity in the developing device 74 is attracted to the collecting roller 82 to which a positive voltage is applied by electrostatic force. Thereafter the toner is scraped from the collecting roller 82 by the scraper 83 to fall in the direction of the arrow C.

If the scraper 83 is made of metal, it has to be electrically isolated from ground. Because the collecting roller 82 is electrically connected to ground, voltage applied thereto leaks to the ground when the scraper 83 is directly grounded. Therefore a protecting resistor (not shown) is inserted between the scraper 83 and ground. The electric resistance is desirably at least $10^6\Omega$, preferably more than $10^9\Omega$ and less than $10^{12}\Omega$.

If resin is used for the scraper, the electric resistance thereof needs to be regulated. Since the collected toner tends to adhere to resin it tends not to fall by gravity. Therefore it is desirable to use a semiconductor material for the scraper, preferably one having a resistance which is more than $10^9\Omega$ and less than $10^{12}\Omega$.

In the fourth embodiment, the collected toner is scraped off by the scraper 83 slips along the surface of the scraper 83 and falls in the direction of the arrow C so as to be returned through the toner recycling route 77 into the developing device 74. Consequently, the fourth embodiment can obtain the same effect as that of the third embodiment.

Figure 6:
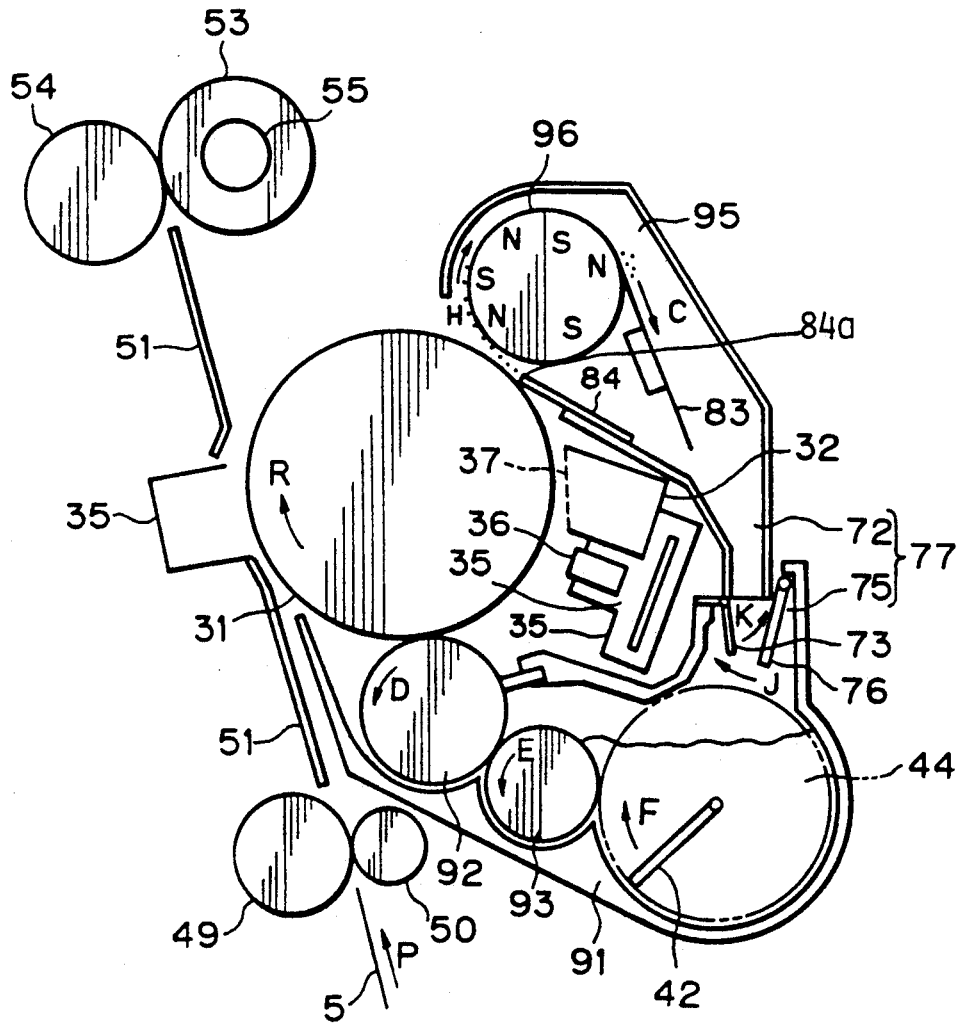
FIG. 6 is a schematic side view showing the main portion of an electrophotographic printer according to the fifth embodiment of the present invention.

Fifth Embodiment (FIG. 6)

The fifth embodiment of the present invention will be described hereinafter with reference to FIG. 6.

FIG. 6 is a schematic side view of a main portion of the electrophotographic printer according to the fifth embodiment of the present invention. The fifth embodiment employs a magnetic toner for developer. The magnetic toner comprises powdered magnetic material uniformly blended in the resin which is the main component of the toner so as to be attracted by magnetic force. In FIG. 6, a developing device 91 is composed of a developing roller 92, a transporting roller 93 and the stirring roller 42. The developing roller 92 is covered by a cylindrical sleeve of nonmagnetic material, and is equipped therein with a magnet roll which is uniformly magnetized in the longitudinal direction thereof. Various magnetizing patterns on the magnet roll are proposed according to the developing methods employed. Some methods employ rotating magnet rolls and others employ nonrotating ones, while the fifth embodiment employs the method of rotating the magnet roll which is equally divided into portions.

The cleaning device 95 is composed of a collecting roller 96, the scraper 83 and the blade 84. The collecting roller 96 is composed of a magnet roll which is magnetized uniformly in the longitudinal direction thereof and equally dividedly in the circumferential direction thereof, and the collecting roller 96 is disposed in the vicinity of the edge portion 84*a* of the blade 84 so as to be rotatably in the direction of the arrow H. The scraper 83 and the blade 84 are similar to those described in the fourth embodiment.

In the fifth embodiment, the recycling portion 77 of the collected toner is composed of the toner receiving portion 75 of the developing device 91 and the toner discharge portion 72 of the cleaning device 95. The magnetic toner which remains on the photoconductor 31 is scraped therefrom by the blade 84 and is attracted to the collecting roller 96 by magnetic attraction. Thereafter, the toner is separated from the collecting roller 96 by the scraper 83 and falls in the direction of the arrow C. Consequently, the fifth embodiment obtains the same effect as those of the third and fourth embodiments.

Sixth Embodiment

Figure 7:
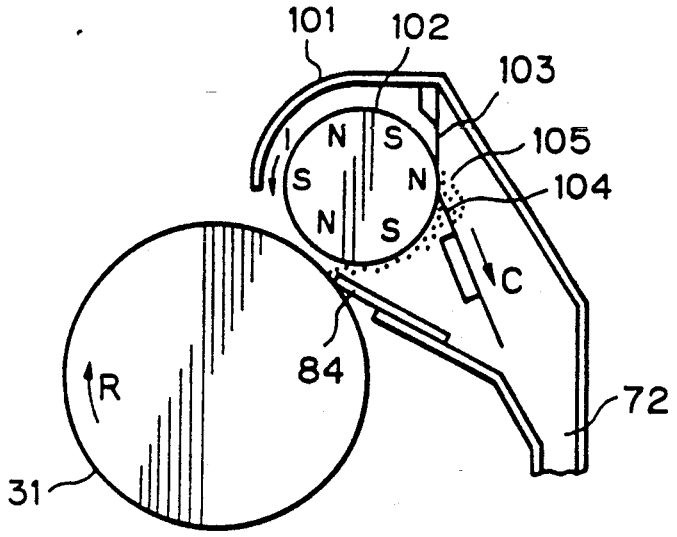
FIG. 7 is a schematic side view showing a cleaning device of an electrophotographic printer according to the sixth embodiment of the present invention.

FIG. 7 is a schematic side view of a main portion of an electrophotographic printer according to the sixth embodiment of the present invention. The present embodiment employs a magnetic toner for the developer like that of the fifth embodiment, but is different therefrom in the construction of its cleaning device.

In FIG. 7, a cleaning device 101 is composed of a cleaning roller 102, a scraper 103, a guide 104 and the blade 84. The cleaning roller 102 is composed of a permanent magnet which is uniformly magnetized in the longitudinal direction thereof and rotates in the direction of the arrow I. The scraper 103 for scraping off the toner on the cleaning roller 102 is formed of polyester or a metal foil. The guide 104, for guiding the toner scraped off by the scraper 103 to the toner discharge portion 72, is composed of an elastic film.

The magnetic toner scraped off the photoconductor 31 by the blade 84 is attracted to the cleaning roller 102, transported to the contact portion of the scraper 103 passing under the guide 104 as the cleaning roller 102 is turned in the direction of the arrow I, and is scraped off by the scraper 103. The toner gathered on the scraper 103 forms a chain of toner by the magnetic force of the cleaning roller 102 and is moved from the toner reservoir 105 toward the guide 104 by the variation of magnetism due to the rotation of the cleaning roller 102. The tip of the guide 104 is disposed so as to be substantially in contact with the scraper 103 and the cleaning roller 102. The magnetic toner scraped off by the scraper 103 is guided by the guide 104 to fall into the toner discharge portion 72.

Figure 8:
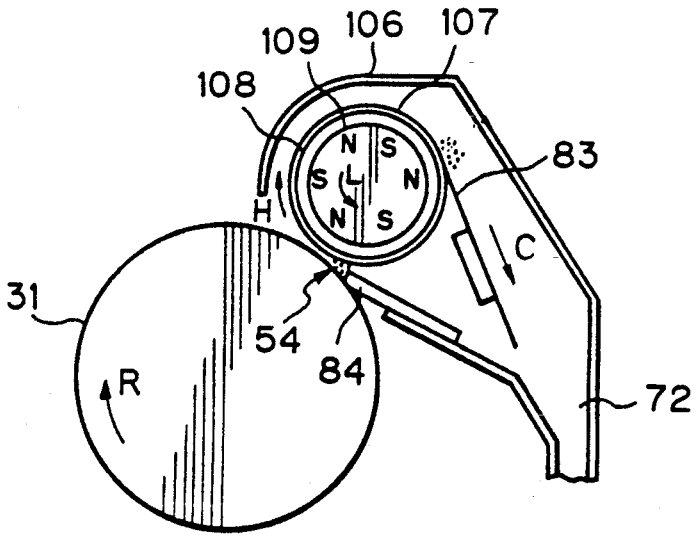
FIG. 8 is a schematic side view showing a cleaning device of an electrophotographic printer according to the seventh embodiment of the present invention.
Figure 9:
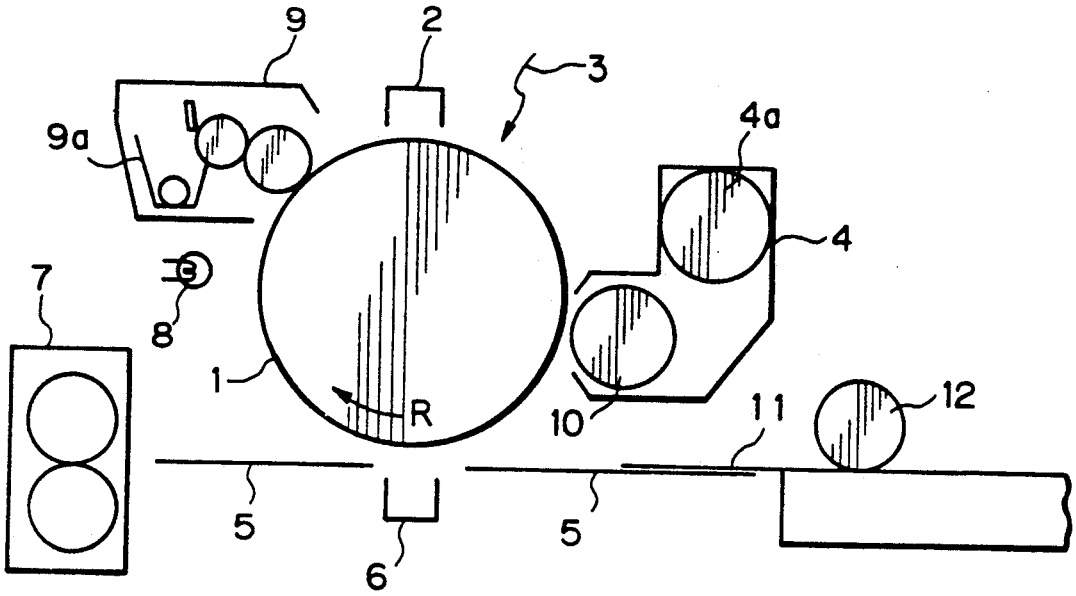
Fig. 9 PRIOR ART
FIG. 9 is a schematic side view of a conventional electrophotographic printer.
Figure 10:
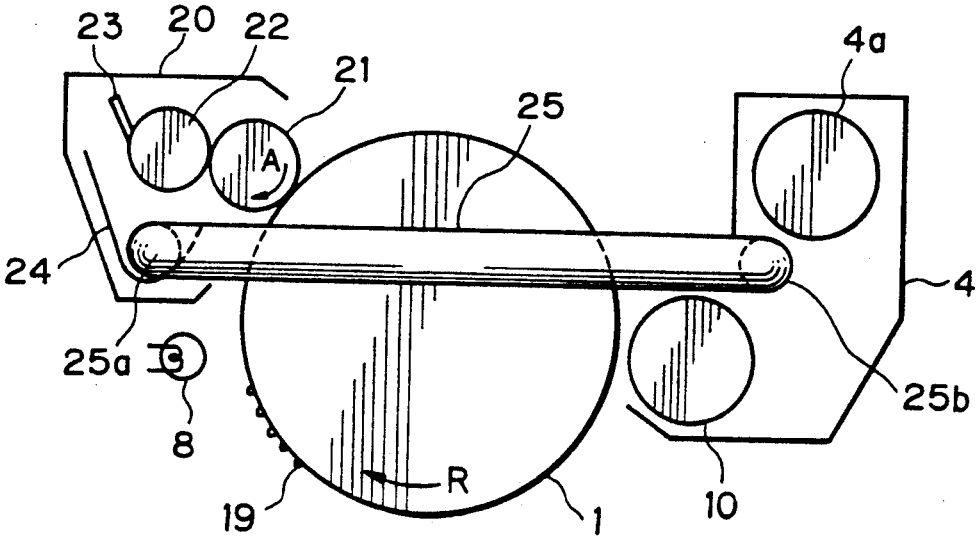
Fig. 10 PRIOR ART
FIG. 10 is a side elevational view showing a conventional electrophotographic printer.
Figure 11:
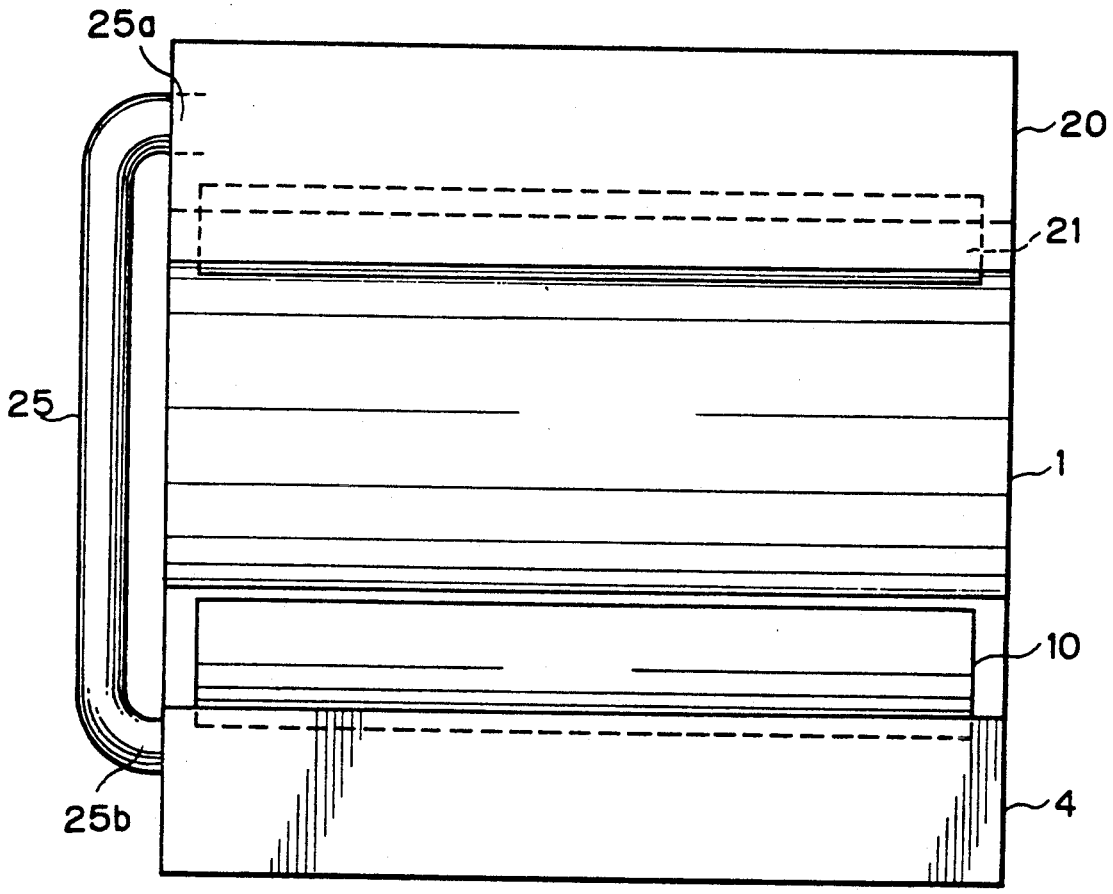
Fig. 11 PRIOR ART
FIG. 11 is a schematic plain view showing a conventional toner recycling mechanism electrophotographic printer.

Seventh Embodiment (FIG. 8)

FIG. 8 is a schematic side view of a main portion of an electrophotographic printer according to a seventh embodiment of the present invention. The present embodiment also employs a magnetic toner for the developer like that of the fifth embodiment but is different therefrom in the construction of its cleaning device.

In FIG. 8, a cleaning device 106 of the electrophotographic printer according to the seventh embodiment comprises a cleaning roller 107 and a scraper 83. The cleaning roller 107 comprises a cylindrical nonmagnetic sleeve 108 on the circumference thereof.

A permanent magnet 109 which is uniformly magnetized in the longitudinal direction thereof is disposed in the sleeve 108. The sleeve 108 rotates in the direction of the arrow H and the permanent magnet rotates in the direction of the arrow L independently.

The toner having residual magnetism scraped off from the photoconductor 31 by the blade 84 and attracted to the cleaning roller 107 is transported in the direction of the arrow H to the contact portion of the scraper 83 as the sleeve 108 is turned, and is scraped off and gathered by the scraper 83. The gathered toner forms a chain of toner by the magnetic force of the cleaning roller 107 and is guided along the surface of the scraper 83 in the direction of the arrow C. The toner then falls into the toner discharge portion 72 since the cleaning roller 107 rotates in the direction opposite to that of the permanent magnet 109.

As described above, the electrophotographic printers according to the sixth and seventh embodiments can also attain the object of the present invention. Consequently, the present invention can be applied to various types of electrophotographic printers.

What is claimed is:

1. An electrophotographic printer comprising a photoconductor having a surface on which an electrostatic latent image is formed, said photoconductor having a printing width in a longitudinal direction thereof;

a developing device for adhering a developer to said electrostatic latent image and developing said image;

a transferring device for transferring the developed latent image to a recording medium;

a cleaning device for collecting developer remaining on the surface of said photoconductor, said cleaning device comprising a brushing roller for removing developer from the surface of said photoconductor, a collecting roller for collecting developer deposited on said brushing roller, and a scraper contacting said collecting roller for removing developer collected thereon;

a passageway connecting said cleaning device and said developing device, said passageway having a width extending in said longitudinal direction extending along the entire printing width of said photoconductor and a length extending in a vertical direction substantially perpendicular to said longitudinal direction, developer scraped from said collecting roller being transferred through said passageway entirely by gravity from said cleaning device to said developing device;

an exposing light source positioned between said developing and cleaning devices and interposed between said photoconductor and said passageway, said exposing light source comprising an array of light emitting elements disposed in said longitudinal direction along the entire printing width of said photoconductor; and an electrifier interposed between said cleaning device and said exposing light source.

2. An electrophotographic printer according to claim 1 wherein the array of light emitting elements in said exposing light source are light emitting diodes.

3. An electrophotographic printer according to claim 1, wherein said passageway comprises:

a developer discharge portion having an opening formed at the lower portion of said cleaning device for leading the collected developer downward; and a developer receiving portion having an opening formed at the upper portion of said developing device which joins said toner discharge portion.

4. An electrophotographic printer according to claim 3, further comprising:

a first shutter for closing the developer discharge portion of said passageway, and a second shutter for closing the developer receiving portion of said passageway.

5. An electrophotographic printer according to claim 3, further comprising at least one of a first shutter for closing the developer discharge portion of said passageway and a second shutter for closing the developer receiving portion of said passageway.

* * * * *